United States Patent [19]

Brook et al.

[11] 4,073,400

[45] Feb. 14, 1978

[54] GAS CONTAINERS

[75] Inventors: Greville Bertram Brook, High Wycombe; William Henry Bowyer, Farnham; Charles Desmond Desforges, Chalfont-St-Giles, all of England

[73] Assignee: Fulmer Research Institute, Stoke Poges, England

[21] Appl. No.: 631,321

[22] Filed: Nov. 12, 1975

[30] Foreign Application Priority Data

Nov. 15, 1974 United Kingdom ..... 49576/74

[51] Int. Cl.[2] ..... B65D 25/14

[52] U.S. Cl. ..... 220/63 R; 220/3; 220/83; 428/35; 428/222; 428/292; 428/902; 428/457; 428/458

[58] Field of Search ..... 220/3, 63 R, 83; 428/35, 222, 292, 902

[56] References Cited

U.S. PATENT DOCUMENTS

| | | | |
|---|---|---|---|
| 3,240,644 | 3/1966 | Wolff | 220/3 |
| 3,312,575 | 4/1967 | Corbin, Jr. | 220/3 |
| 3,321,101 | 5/1967 | Griffith | 220/3 |
| 3,765,557 | 10/1973 | Giwer | 220/3 |
| 3,843,010 | 10/1974 | Morse et al. | 220/3 |
| 3,908,851 | 9/1975 | Jacobs | 220/3 |

FOREIGN PATENT DOCUMENTS

| | | |
|---|---|---|
| 1,315,653 | 5/1973 | United Kingdom. |
| 1,346,046 | 2/1974 | United Kingdom. |
| 1,346,047 | 2/1974 | United Kingdom. |

*Primary Examiner*—William R. Dixon, Jr.
*Attorney, Agent, or Firm*—Bacon & Thomas

[57] ABSTRACT

A lightweight gas container comprising walls formed of two bonded layers, the outer layer being formed of a fibre-reinforced synthetic resin and the inner layer being formed of a metal alloy which has a high and reversible elasticity and good fatigue resistance.

5 Claims, No Drawings

GAS CONTAINERS

This invention is concerned with portable gas containers adapted to contain gases and liquified gases under super-atmospheric pressures.

Conventional gas containers for this purpose are fabricated of steel and are very heavy in relation to their useful capacity, making the larger sizes of such containers difficult, and potentially dangerous, to handle.

With a view to increasing the capacity/weight ratio, proposals have been made to form a gas container from a composite material comprising an outer layer of fibre-reinforced synthetic resin and an inner layer or lining of a metal, such as aluminium or steel, the intention being that the outer layer, which has a much lower density than steel, should be able to withstand the mechanical stresses imposed on the container during use and the lining should provide the necessary gas impermeability and corrosion resistance. In practice, however, gas containers fabricated in accordance with such proposals have had a high failure rate and have, therefore, not been commerically adopted to any significant extent.

We have now found that failures in such composite material gas containers can be substantially reduced or eliminated by using a lining metal which has a high and reversible elasticity and good fatigue resistance.

According to the present invention, therefore, we provide a gas container, the walls of which are formed of two bonded layers, the outer layer being formed of a fibre-reinforced synthetic resin and the inner layer of a metal alloy which (a) is capable of deforming elastically to the working strain of the outer layer which is greater than 0.1%,
(b) is resistant to fatigue damage when cyclic strains greater than 0.1% are applied,
(c) has an $M_s$ temperature below the operating temperature of the container, and
(d) is resistant to corrosion by the gas which the container is intended to contain.

In connection with characteristic (c) of the metal alloy, the operating temperature of a gas container can for normal use be taken as room temperature, but when the container is used for cryogenic storage of gas, the operating temperature will be the cryogenic temperature employed.

In theory, the greater the ability of the metal alloy to deform elastically and to resist fatigue damage when cyclically stressed, the better. In practice, there is no purpose in the metal alloy having significantly better properties in these respects than the fibre-reinforced outer layer. The working strain of the latter is not normally more than 2% and metal alloys which are capable of meeting this limit in respect of characteristics (a) and (b) are, in substantially all cases, satisfactory.

As regards characteristic (c), it is preferred that the $M_s$ temperature of the metal alloy should be at least 50° C, and more preferably at least 100° C, less than the operating temperature of the container. The $M_s$ temperature is the temperature at which martensite transformation starts in the absence of externally applied stress.

Particular alloys which are suitable for use in containers intended to operate at room temperature include, for example (all compositions are by weight):

1. Fe - Mn, 15.0% - Ni, 6.4% - Cr, 10.0 - 15.0%
2. Fe - Mn, 20.0% - Ni, 10.0%
3. Fe - Mn, 20.0% - Cr, 10.0%
4. Fe - Ni, 15.0% - Cr, 25.0%
5. Fe - Mn, 25.0 - 30.0%

6. Cu - Zn, 38.6 - 41.5%
7. Cu - Zn, 17.0 - 19.0% - Al, 6.75 - 7.5%
8. Cu - Zn, 31.0% - Sn, 5.0%
9. Cu - Zn, 30.0 - 31.0% - Si, 2.25 - 5.0%
10. Cu - Al, 10.75% - Mn, 10.0%
11. Cu - Al, 13.75% - Ni, 5.0%
12. Ni - Ti, 44.5%
13. Au - Cd, 35.0%

The balance of the alloy composition in each of the above examples is the first element indicated together with incidental impurities.

Other suitable silver-base, gold-base, cobalt-base, and iron-base alloys are disclosed in British Specification No. 1,346,047. Other suitable iron-base and titanium-base alloys are disclosed in British Specification No. 1,346,046. Uranium-base and manganese-base alloys suitable for use in this invention are disclosed in British Specification No. 1,315,653.

Alloys No. 1, 2, 3, 5 and 12 above are equally suitable for use in containers intended to operate at cryogenic temperatures of from -100° to -196° C. Particular alloys which are suitable for use at such cryogenic temperatures include, for example:

14. Cu - Zn, 40.7%
15. Cu - Zn, 31.75% - Al, 3.5%
16. Cu - Zn, 32.25% - Sn, 6.0%
17. Cu - Zn, 34.5% - Si, 2.25%
18. Cu - Al, 12.5% - Ni, 6.0%
19. Cu - Al, 11.0% - Mn, 10.0%

The balance of the alloy composition in each of alloys No. 14 – 19 is the first element indicated together with incidental impurities.

As regards impurities, it is preferred that the alloy used should have a low content of incidental impurities and preferably not more than 0.1 wt % of total impurities.

In a particular embodiment of the gas container, a third bonded layer is provided inside the metal alloy layer, this third layer being formed of a fibre-reinforced synthetic resin which may be the same as or different from the outer layer. Such a third layer serves to prevent contact between the gas and the alloy layer and when it is present, it is not essential, though still preferred, that the alloy should be corrosion-resistant with respect to the gas.

The resin of which the outer layer and the third layer, if present, are formed may be any of the synthetic resins conventionally used in the production of glass-fibre reinforced plastics (that is g.r.p.) materials. Suitable resins include, for example, epoxy resins, such as Epikote 828 (manufactured by Shell) and MY750 and MY778 (manufactured by Ciba); unsaturated polyester resins, such as Crystic 600 bisphenol polyester (manufactured by Scott Bader); vinyl ester resins, such as Derakane (manufactured by Dow Chemical); and phenolic resins. It is preferred to use resins which are curable at room temperature or only slightly elevated temperatures.

A wide variety of fibrous reinforcements may be present in the resin layer(s); preferred fibres for this purpose are carbon fibres, polybenzamide fibres, such as "Kevlar" fibres available from E. I. DuPont de Nemours & Co., glass fibres, asbestos fibres, boron fibres, metal fibres, and alumina fibres, of which the first three are particularly preferred. The fibre reinforcement may be in staple or filamentary form or may be in the form of a woven or non-woven sheet material.

It is particularly preferred that the fibre reinforcement in the outer layer should be in a continuous filamentary form, that is in the form of continuous filaments or a spun yarn or roving, and that it should be formed as a plurality of helically wound layers by filament winding. For this purpose, the metal alloy layer, in the desired shape of the container, is coated with a layer of liquid synthetic resin before winding is commenced and further liquid synthetic resin is applied after each helically wound layer of reinforcement has been applied or, alternatively, the filament is wound on already coated or impregnated with the liquid synthetic resin.

The composite gas container according to the invention can be made in a number of ways. In one method, the metal alloy is first formed to the desired shape of the container by any suitable metal fabrication method and the outer layer is then formed on the outside of the metal alloy layer by any procedure suitable for the formation of fibre-reinforced resin articles, preferably by the filament winding procedure described above. Since the metal alloy used has little inherent strength, it may be formed by blow moulding into a suitably shaped split mould in the same general manner as the blow moulding of plastic bottles.

In another method the outer layer is first formed to the desired shape, for example on a suitably shaped removable mandrel, and then the interior of the outer layer is coated with the metal alloy layer by any suitable metal deposition process, for example by electro-deposition or vapour deposition.

In order that the invention may be more fully understood, the following example is given by way of illustration:

EXAMPLE

An ingot of an iron-base alloy of the following composition, by weight:

Fe, 68.6%; Ni, 6.4%; Cr, 10.0%; Mn, 15.0%; C, 0.05%; N, 0.01% was forged at 1100° C to form a 25 mm thick plate and the plate was rolled at 950° C to form an 0.75 mm thick sheet. The sheet was cleaned by shot blasting.

Two approximately hemispherical cups of 100 mm diameter were formed from the sheet by spinning. Holes were formed in the apex of each cup and internally threaded steel spigots (designed to receive the gas inlet/outlet valves) were brazed into the holes. A cylinder having a length of 140 mm and a diameter of 100 mm was formed from a further portion of the sheet and welded, at its ends, to the periphery of the cups, one at each end. Welding was effected by the tungsten inert gas procedure using rods formed by rolling further portions of the sheet as the filler rod.

The completed liner was then pre-strained by pressurising with hydraulic oil to obtain a linear elongation throughout the liner of approximately 1.0%. The liner was then filled with a low melting point wax (m.p. 65° C) to reduce deformation of the liner during the subsequent stage of filament winding.

The wax-filled liner was mounted on a rotatable mandrel and filament wound with a bundle of carbon continuous filaments. The carbon fibre bundle was precoated or impregnated with liquid epoxy resin plus hardener composition (Epikote 828 with MNA hardener) before being passed to the winding apparatus. Filament winding was carried out to provide two layers of hoop windings covering the whole liner, then two layers of polar windings over the whole liner, and then seven layers of hoop windings over the central cylindrical section. The epoxy resin was then cured for 4 hours at 60° C.

In the finished container, the thickness of the fibre-reinforced outer layer in the central cylindrical section was approximately 5 mm and over the hemispherical ends, it was approximately 4.5 mm at the apex progressively reducing to approximately 3 mm where the ends joined the central section.

On pressure testing, it was found that an acceptable working pressure was 7,000 p.s.i.; stress calculations show that failure of the container should not take place until a pressure of 22,000 p.s.i. is reached.

What is claimed is:

1. A gas container, the walls of which are formed of two bonded layers, the outer layer being formed of a fibre-reinforced synthetic resin having a working strain which is greater than 0.1% and the inner layer of a metal alloy, which inner layer of metal alloy:

(a) is capable of deforming elastically to the working strain of the outer layer up to a strain of at least about 2%,
(b) is resistant to fatigue damage when cyclic strains up to about 2% are applied,
(c) has an $M_s$ temperature at least 50° C below the operating temperature of the container, and
(d) is resistant to corrosion by the gas which the container is intended to contain.

2. A gas container as set forth in claim 1, wherein said metal alloy is selected from the group consisting of alloys of the following composition by weight (a) Fe - Mn, 15.0% - Ni, 6-4% - Cr, 10.0 - 15.0%,
(b) Fe - Mn, 20.0% - Ni, 10.0%,
(c) Fe - Mn, 20.0% - Cr, 10.0%,
(d) Fe - Ni, 15.0% - Cr, 25.0%,
(e) Fe - Mn, 25.0 - 30.0%,
(f) Cu - Zn, 38.6 - 41.5%,
(g) Cu - Zn, 17.0 - 19.0% - Al, 6.75 - 7.5%,
(h) Cu - Zn, 31.0% - Sn, 5.0%,
(i) Cu - Zn, 30.0% - 31.0% - Si, 2.25 - 5.0%,
(j) Cu - Al, 10.75% - Mn, 10.0%,
(k) Cu - Al, 13.75% - Ni, 5.0%,
(l) Ni - Ti, 44.5%,
(m) Au - Cd, 35.0%,
(n) Cu - Zn, 31.75% - Al, 3.5%
(o) Cu - Zn, 32.25% - Sn, 6.0%,
(p) Cu - Zn, 34.5% - Si, 2.25%,
(q) Cu - Al, 12.5% - Ni, 6.0%,
(r) Cu - Al, 11.0% - Mn, 10.0%.

3. A gas container as set forth in claim 1, which additionally comprises a third bonded layer inside the metal alloy layer, said third layer being formed of a fibre-reinforced synthetic resin.

4. A gas container as set forth in claim 1, wherein the fibres present in the fibre-reinforced layer are selected from the group consisting of carbon fibres, polybenzamide fibres, glass fibres, asbestos fibres, boron fibres, metal fibres and alumina fibres.

5. A gas container as set forth in claim 1, wherein the fibre reinforcement of the outer layer is in a continuous filamentary form and is formed as a plurality of helically wound layers by filament winding.

* * * * *